United States Patent [19]

Lee

[11] Patent Number: 4,844,468

[45] Date of Patent: Jul. 4, 1989

[54] GOLF PUTTER

[76] Inventor: Michael J. Lee, 978 Burke Ave., Roseville, Minn. 55113

[21] Appl. No.: 150,916

[22] Filed: Feb. 1, 1988

[51] Int. Cl.[4] ..... A63B 53/00; A63B 69/36

[52] U.S. Cl. ..... 273/163 R; 273/194 A; 273/194 B

[58] Field of Search ..... 273/35 A, 183 E, 194 R, 273/194 A, 163 R, 183 D, 186 A, 194 B, 164, 167 F, 169

[56] References Cited

U.S. PATENT DOCUMENTS

| | | | |
|---|---|---|---|
| 1,327,171 | 1/1920 | Ruggles . | |
| 1,556,062 | 10/1925 | Baugh . | |
| 2,463,798 | 3/1949 | Paisley . | |
| 2,503,506 | 4/1950 | Miller | 273/183 D |
| 3,220,733 | 11/1965 | Saleeby | 273/164 |
| 3,273,891 | 9/1966 | Grim, Jr. . | |
| 3,310,309 | 3/1967 | Moss . | |
| 3,421,765 | 1/1969 | Scott . | |
| 3,516,674 | 6/1970 | Scarborough . | |
| 3,606,327 | 9/1971 | Gorman . | |
| 3,727,920 | 4/1973 | Scott | 273/194 A |
| 3,810,633 | 5/1974 | Scott, III | 273/183 D |
| 3,880,430 | 4/1975 | McCabe | 273/164 |
| 3,941,390 | 3/1976 | Hussey | 273/167 F |
| 3,995,865 | 12/1976 | Cochran et al. | 273/167 F |
| 4,025,078 | 5/1977 | Pelz | 273/194 B |
| 4,053,160 | 10/1977 | Salata | 273/186 A |
| 4,413,824 | 11/1983 | King et al. | 273/163 R |
| 4,508,350 | 2/1985 | Duclos | 273/183 D |
| 4,519,612 | 5/1985 | Taso | 273/163 R |
| 4,527,799 | 7/1985 | Solheim | 273/164 |
| 4,573,685 | 3/1986 | Young, IV et al. | 273/173 |
| 4,601,472 | 7/1986 | O'Flanagan | 273/186 A |
| 4,650,191 | 3/1987 | Mills | 273/169 |

FOREIGN PATENT DOCUMENTS

| | | | |
|---|---|---|---|
| 16834 | 7/1906 | United Kingdom | 273/194 A |

*Primary Examiner*—Edward M. Coven
*Assistant Examiner*—Gary Jackson
*Attorney, Agent, or Firm*—Palmatier & Sjoquist

[57] ABSTRACT

A golf putter comprised of a putter head having an unique site aligning groove and bead arrangement with a rearwardly located attachment mounting face thereon. A removeable mirror attachment with a corresponding mounting face engageable with the putter head mounting face is also provided with an interchangeable weight attachment of comparable weight with the removable mirror attachment also having a mounting face engageable with the putter head mounting face. The combination of threaded aperture, apertures in the attachments and thumbscrews releasably interconnect either the mirror attachment or weight attachment to the putter head.

8 Claims, 2 Drawing Sheets

GOLF PUTTER

BACKGROUND OF THE INVENTION

This invention relates to a golf putter with an interchangeable sight aligning mirror attachment and a weight attachment of comparable weight to the mirror attachment.

Putting a golf ball with a golf putter on the green requires much practice and expertise to insure that the golf ball is accurately struck with the golf putter to move the golf ball into the hole or cup on the green. The angularity of the striking face of the golf putter is most critical in determining the direction in which the ball moves after it is struck.

It is very important for new or young golfers to learn the proper swing, club positioning and stance necessary for a true and accurate putt. Even upon proper learning, years of practice are typically necessary to permit the golfer to properly sight the ball with respect to the club and the cup and to enable the golfer to positively position the striking face of the putter perpendicular to the desired path of movement of the golf ball. Ideally, the striking face of the putter should be at right angles, both horizontally and vertically, to the line extending between the golf ball and the cup at the moment of impact of the putter head with the ball.

It must be recognized however that attachments, such as mirrors, cannot be used in competition play as sanctioned by the United States Golf Association (U.S.-G.A.) because such putters violate the Rules of Golf, specifically Rule 14-3, Artificial Devices.

SUMMARY OF THE INVENTION

A golf putter comprised of a putter head having an unique site aligning groove and bead arrangement with a rearwardly located attachment mounting face thereon. A removable mirror attachment with a corresponding mounting face engageable with the putter head mounting face is also provided with an interchangeable weight attachment of comparable weight with the removable mirror attachment also having a mounting face engageable with the putter head mounting face. The combination of threaded aperture, apertures in the attachments and thumbscrews releasably interconnect either the mirror attachment or weight attachment to the putter head.

A principle advantage and objective of this invention is that it provides a golf putter with a mirror attachment for putting practice and a weight attachment of comparable weight to the mirror attachment. The club has substantially the same mass for accurate putting whether using the mirror attachment for practice putting or the weight attachment for competition play.

Another advantage and objective is that the golf putter permits the experienced golfer to improve his game and speed up the learning process for an amateur by aiding the golfer to learn the necessary angularity requirements between the striking face of the putter, the golf ball and the cup on the green, as well as the proper pendulum swing for true and accurate play.

The present invention further provides a golf putter that does not interfere with the weight or balance of the club which provides both a mirror attachment and a weight attachment which may be easily and quickly interchanged.

The golf putter, when using the weight attachment, most advantageously conforms to all U.S.G.A. rules for competition play.

Finally, this invention provides a unique sight alignment arrangement not heretofore known.

DETAILED SPECIFICATION OF THE INVENTION

The golf putter of the present invention generally includes a putter head 14 with a rear mounting face 34 with a interchangeable weight attachment 44 and mirror frame attachment 56 connectable to the rear mounting face 34.

Figure 1:
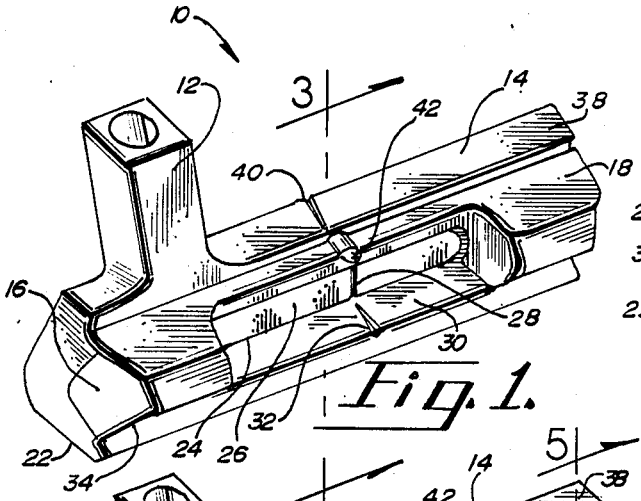
FIG. 1 is a rear prospective view of the putter head of the invention.
Figure 3:
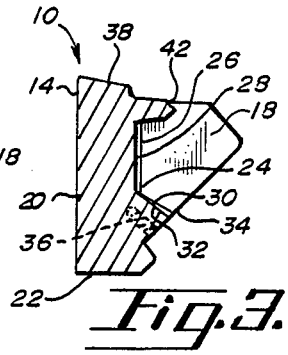
FIG. 3 is a cross sectional view of the putter head taken along lines 3—3 of FIG. 1.
Figure 2:
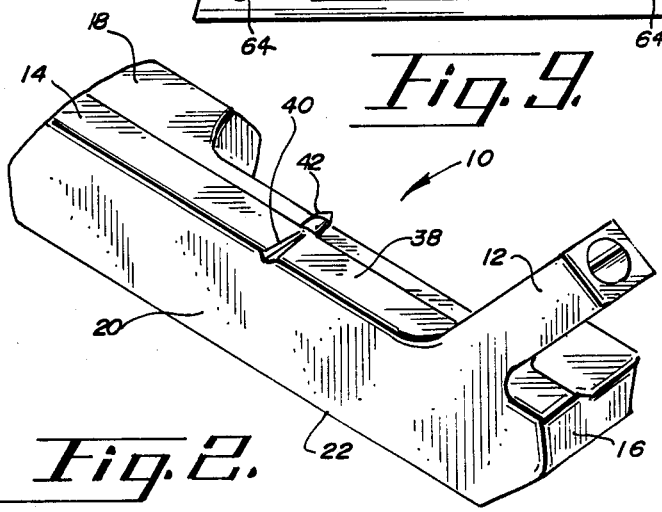
FIG. 2 is a front prospective view of the striking face and putter head.

Referring to FIGS. 1, 2 and 3, the details of putter head 14 may be seen. Golf putter 10 includes putter head 14 with upwardly extending shaft 12. Putter head 14 may be conveniently made of cast aluminum or injection molded plastic. Weighted heel section 16 and weighted toe section 18 give the putter head 14 a high polar moment of inertia to resist twisting during the putting swing and broaden the sweet spot of the putter 10 to reduce off center golf ball hits. Putter head 14 also has generally vertical striking face 20 and sole 22.

Between weighted heel and toe sections 16 and 18, rear central recess 24 is located having vertical surface 26 with sight alignment groove 28 centrally located thereon and substantially horizontal surface 30 with a second sight alignment groove 32 centrally located thereon. Preferably, horizontal surface 30 has a 7° slope downwardly and rearwardly. Rear mounting face 34 is suitable for engagement with weight attachment 44 and mirror frame attachment 56, as discussed fully below and face 34 also has threaded apertures 36 distally located thereon.

Putter head 14 also has top surface 38 with alignment groove 34 thereon. Top surface 38 preferably has a 7° slope rearwardly and downwardly. Located centrally and rearwardly of top surface 38 is sight bead 42.

Figure 4:
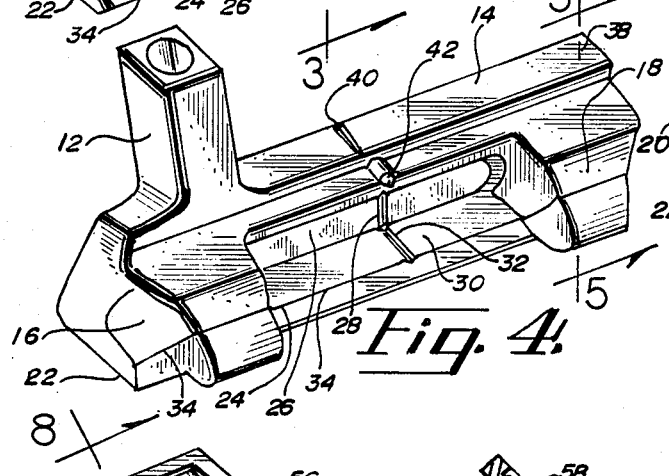
FIG. 4 is a rear prospective view of the putter head with interconnected weight attachment thereon.
Figure 5:
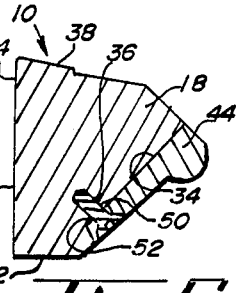
FIG. 5 is a cross sectional view of the putter head taken along lines 5—5 of FIG. 4.
Figure 6:
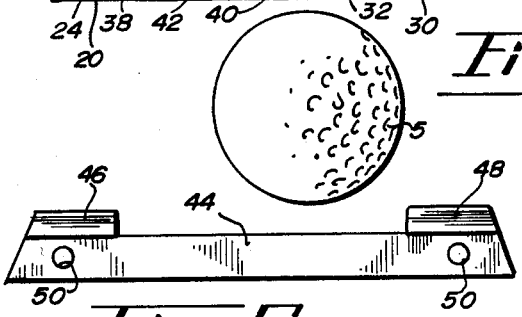
FIG. 6 is a rear elevational view of the weight attachment.

Referring to FIGS. 4, 5 and 6, weight attachment 44 may be clearly seen. Weight attachment 44 includes weighted heel section 16 and weighted toe section 18 to further add a high polar moment of inertia to putter head 14 as weighted heel and toe sections 16 and 18 when weight attachment 44 is removably affixed to rear mounting face 34. Apertures 50 are located on weight attachment 44 through mounting face 52 for appropriate alignment with threaded aperture 36 of putter head 14. Weight attachment 44 is suitably made of brass which has a higher density than aluminum or plastic and which will permit the weight attachment 44 to have a comparable or equal weight to larger mirror frame attachment 56.

Thumb screws 54 are appropriately threaded for fitting in threaded apertures 36 and of a size to readily pass through weight attachment apertures 50.

Figure 7:
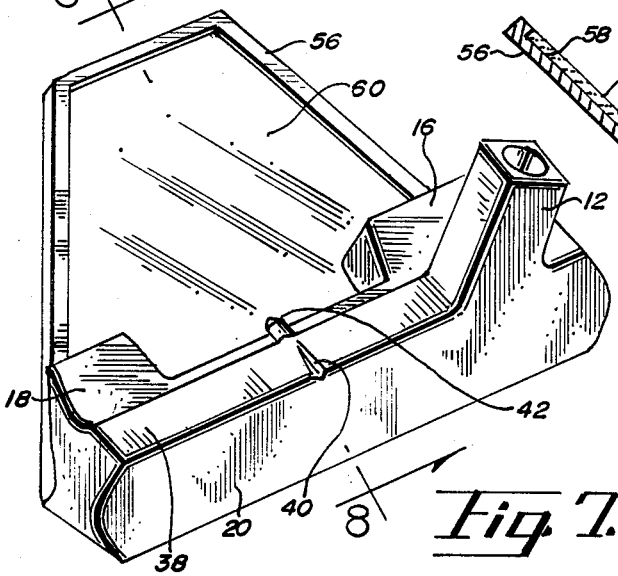
FIG. 7 is a front prospective view of the putter head with the mirror attachment.
Figure 8:
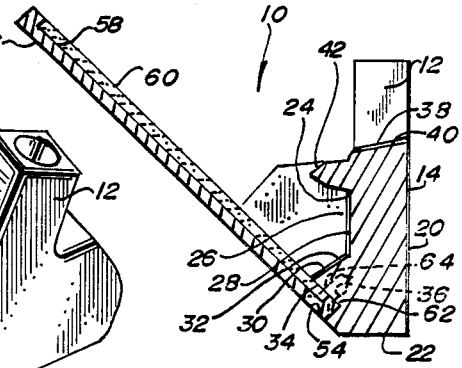
FIG. 8 is a cross sectional view of the putter head with mirror attachment taken along lines 8—8 of FIG. 7.
Figure 9:
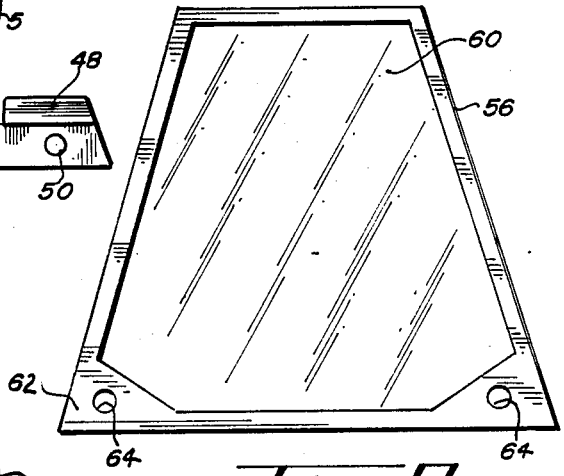
FIG. 9 is a front elevational view of the mirror attachment.

Referring to FIGS. 7, 8 and 9, the mirror frame attachment may be seen. Mirror frame attachment 56 has a recessed face 58 which will permit the insertion therein of mirror 60 suitable held thereat by adhesive or the like. The lower front portion of mirror frame attachment 56 includes mounting face 62 which cooperatively engages with rear mounting face 34 of putter head 14 and suitably has frame mounting surface 64 with apertures 64 distally located thereat which will permit thumb screws 54 to pass therethrough.

Figure 11:
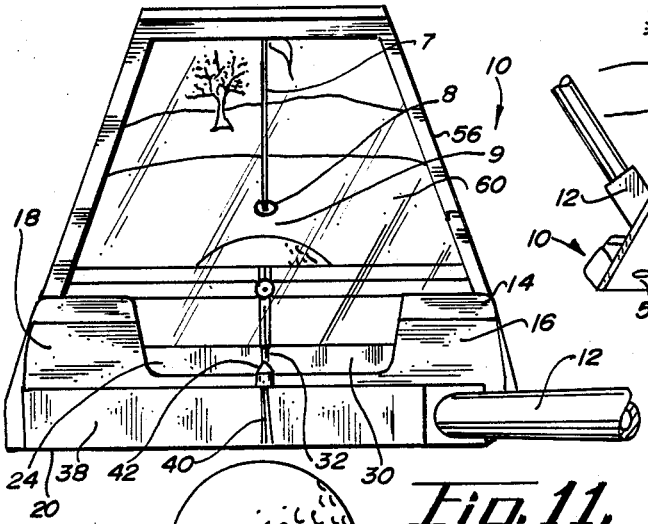
FIG. 11 is a top view of the putter head as seen from the golfer's eye while practice putting on the green.
Figure 10:
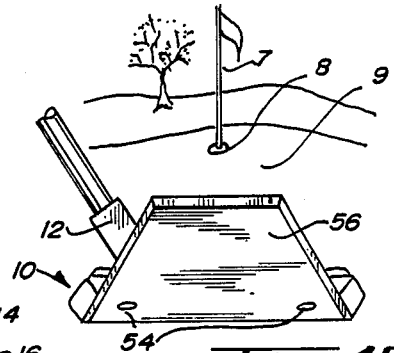
FIG. 10 is a rear elevational view of the golf putter in operation on a golf course green.

Referring to FIGS. 10 and 11, the operation of golf putter 10 may be understood. Assuming that the golfer connected mirror frame attachment 56 to rear mounting face 34 of putter head 14 with the aid of thumb screws 54, the putter 10 is ready for putting practice. FIG. 10 shows the view from immediately behind the striking face 20 while on the putting green 9 showing pin 7 and cup 8.

FIG. 11 shows the cooperation of properly mounted mirror 16 and sight alignment grooves 28, 32 and 40 together with sight bead 42. When the golfer's eye is directly over putter head 14, sight bead 42 is in line with sight alignment groove 32 on horizontal surface 30 which is appropriate for both practice and competition putting. Horizontal surface 30 and top surface 38 are sloped approximately 7° downwardly and rearwardly to render themselves more visible to the golfer's eye in reflective mirror 62 thereby rendering sight alignment grooves 32 and 40 visibly alignable within mirror 60.

Once sight alignment grooves 28, 32 and 40 are in line with the pin 7 and cup 8 on putting green 9, as reflected in mirror 60, the striking face 20 is appropriately perpendicular to pin 7 and cup 8. With cup 8 and the top portion of golf ball 5 visible in mirror 60, the golfer may be assured that the striking face 20 is appropriately vertical or perpendicular to the green 9 where the golf ball rests for appropriate, accurate and true striking of golf ball 5.

Continued practice with mirror attachment 56 will eventually give the golfer the appropriate mental image of the proper alignment of the putter 10 and golf ball 5 to assure a true and accurate play. The golfer simply interchanges the mirror frame attachment 56 with weight attachment 44 for competition play. This interchange will not interfere with the weight and balance of the club due to the fact that weight attachment 44 and mirror frame attachment 56 are of comparable weight.

The present invention may be embodied in other specific forms without departing from the spirit or essential attributes thereof, therefore, the illustrated embodiment should be considered in all respects as illustrative and not restrictive, reference being made to the appended claims rather than to the foregoing description to indicate the scope of the invention.

What is claimed is:

1. A golf putter with an interchangeable sight aligning mirror attachment for putting practice and a weight attachment of comparable weight to the mirror attachment which comfortably permits the club to have substantially the same mass for accurate putting whether using the mirror attachment for practice putting or the weight attachment which permits the putter to conform to United States Professional Golf Association Competition Rules, comprising:

(a) a putter head with a golf ball striking face and a rearwardly located attachment mounting face;

(b) a removable mirror attachment with a mounting face engagable with the putter head mounting face;

(c) a weight attachment of comparable mass to the mirror attachment interchangeable with the removable mirror attachment having a mounting face engageable with the putter head mounting face;

(d) means for releasably interconnecting either the weight attachment or mirror attachment to the putter head;

(e) a rear central recess having a vertical surface centrally located with a first sight alignment groove thereon and a substantially horizontal surface with a centrally located second sight alignment groove thereon; and (f) a top on the putter head with a centrally located third alignment groove thereon and a centrally and rearwardly located sight bead thereat, the sight bead and first, second and third alignment grooves are in line together.

2. The golf putter of claim 1, further comprising weighted heel and toe sections giving the putter a high polar moment of inertia to resist twisting of the putter during putting.

3. The golf putter of claim 1, wherein the mirror attachment is approximately 45° from the striking face as it extends upwardly and rearwardly from the putter head.

4. The golf putter of claim 1, wherein the sight bead is adapted to be aligned with the second sight alignment groove of the horizontal surface of the central recess when the golfer's eye is directly over the putter head.

5. The golf putter of claim 1, further comprising a top surface on the putter head and wherein the top surface and the horizontal surface within the central recess slope rearwardly and downwardly approximately 7° to make the respective surfaces more visible within the mirror attachment.

6. The golf putter of claim 1, wherein the weight attachment has weighted heel and toe section giving the putter a high polar moment of inertia to resist twisting of the putter during putting.

7. The golf putter of claim 1, wherein the means comprises a threaded aperture in the putter head, a second aperture in the mirror attachment, a third aperture in the weight attachment and thumb screws.

8. A golf putter with an interchangeable sight aligning mirror attachment for putting practice and a weight attachment of comparable weight to the mirror attachment which comfortably permits the club to have substantially the same mass for accurate putting whether using the mirror attachment for practice putting or the weight attachment which permits the putter to conform to United States Professional Golf Association Competition Rules, comprising (a) a putter head having a rearwardly located attachment mounting face, a top surface slightly sloping rearwardly and downwardly, a rear central recess with a vertical surface having a centrally located first sight alignment groove thereon and a substantially horizontal surface slightly sloping rearwardly and downwardly having a centrally located second sight alignment groove thereon, the top surface having a centrally located third sight alignment groove thereon, and a sight alignment bead located centrally and rearwardly of the top surface so that the bead is viewed in the second alignment groove when the golfer's eye is directly over the putter head;

(b) a removable mirror attachment with a mounting face engagable with the putter head mounting face so that the mirror attachment extends upwardly and rearwardly approximately 45° from the striking face rendering the first, second and third sight alignment grooves and sight bead visible by the golfer in the mirror attachment as well as the top of the golf ball and the target pin and cup;

(c) a weight attachment having substantially the same mass as the mirror attachment interchangeable with the removable mirror attachment having a mounting face engagable with the putter head mounting face; and (d) means for releasably interconnecting either the weight attachment or mirror attachment to the putter head.

* * * * *